US005413028A

United States Patent [19]

Ng et al.

[11] Patent Number: 5,413,028

[45] Date of Patent: May 9, 1995

[54] WEAPON STABILIZATION SYSTEM

[75] Inventors: Michael S. Ng, Grosse Pointe Park; Arthur J. Wroble, Grosse Pointe Shores, both of Mich.

[73] Assignee: Cadillac Gage Textron Inc., Warren, Mich.

[21] Appl. No.: 150,890

[22] Filed: Nov. 12, 1993

[51] Int. Cl.[6] ..... F41G 5/16

[52] U.S. Cl. ..... 89/41.09; 89/37.08; 89/41.04; 89/41.12; 91/364

[58] Field of Search ..... 89/37.08, 41.04, 41.09, 89/41.12; 91/364

[56] References Cited

U.S. PATENT DOCUMENTS

| | | | |
|---|---|---|---|
| 3,405,599 | 10/1968 | Barlow et al. | 89/41.09 |
| 4,256,015 | 3/1981 | Tippetts et al. | 89/41.12 |
| 4,570,530 | 2/1986 | Armstrong | 89/41.09 |
| 4,632,012 | 12/1986 | Feige et al. | 89/41.09 |
| 4,924,749 | 5/1990 | Beyer et al. | 89/41.09 |
| 5,014,594 | 5/1991 | Mühlhausen et al. | 89/37.08 |
| 5,101,708 | 4/1992 | Sommer et al. | 89/37.08 |
| 5,196,642 | 3/1993 | Tripp | 89/37.08 |

*Primary Examiner*—Stephen C. Bentley

*Attorney, Agent, or Firm*—Reising, Ethington, Barnard, Perry & Milton

[57] ABSTRACT

A weapon stabilization system for an unbalanced gun tube pivotally mounted on a tank turret or other movable platform is disclosed. The system includes a muzzle position controller which accounts for flexion of the gun tube and which comprises a muzzle reference sensor and a muzzle deflection feedback circuit. The muzzle reference sensor provides a signal indicative of deflections of the gun tube. The muzzle deflection feedback circuit is responsive to this signal to adjust the position of the gun tube in a manner that accounts for the deflections of the gun tube. The gun tube is positioned using a hydraulic actuator with pressure feedback to the stabilization system. The system includes a feedforward controller to compensate for the positive pressure feedback due to dynamic external accelerations acting on the unbalanced gun tube. The feedforward controller comprises one or more sensors that detects these accelerations and a feedforward circuit responsive to the sensors to compensate for the positive feedback. The system further includes a rotational acceleration feedback controller that uses the sensors to provide a damping feedback signal that is related to the rotational acceleration of the gun tube.

15 Claims, 7 Drawing Sheets

100
102
52
142
104
106
140
18'
$d_{cg}$
$d_2$
$d_a$
$d_1$
14'
112
110
108
114
118
116
120
126
130
122
ACTUATOR INPUT
SERVO-VALVE
22'
DIFF. PRESSURE TRANS.
128
134
132
136
124
94a

WEAPON STABILIZATION SYSTEM

TECHNICAL FIELD

This invention relates generally to weapon stabilization systems and in particular, relates to an improved system for stabilizing the position of the muzzle of a gun tube mounted on a vehicle to account for terrain induced and other external disturbances. Although the invention relates generally to any movable platform having an aimable gun mounted thereon, the description that follows is of a system adapted to be used on a main battle tank.

BACKGROUND OF THE INVENTION

Weapon stabilization systems are used on tanks to stabilize the position of the gun tube so that the line of fire can be controlled while the tank is in motion. The operator views the surrounding terrain through a sight head mirror located in the turret. Rotation of the turret permits the operator to look to the left or right of the current view. The sight head mirror is pivotable about a horizontal axis so that, within certain limits, the operator can look above or below the current view. The sight head mirror has its own, independent stabilization system to maintain its position such that it maintains the view selected by the operator regardless of terrain induced disturbances. For targeting purposes a reticle is superimposed on the view given by the sight head mirror. Targeting of an object is then simply accomplished by activating the operator controls to align the reticle with the object. Activation of the operator controls also causes the gun tube to move by an amount which corresponds to that of the sight head mirror. Since the gun tube is aligned in conjunction with the sight head mirror, the line of fire would intersect the object being targeted, except for the existence of a ballistic solution which corrects for speed of the targeted object (in the case of a moving target) and for elevational requirements due to the trajectory of the bullet.

The goal of the weapon stabilization system is therefore to maintain the line of fire in the direction selected via the operator controls, regardless of terrain induced disturbances or other influencing factors. This is accomplished in conventional stabilization systems by assuming that the position of the gun tube, as measured at the gun mount, gives the exact position of the gun muzzle (i.e., the discharging end of the gun tube).

However, in the quest for longer ranging direct fire weapons, tank gun tubes are becoming longer, bringing with them associated stabilization problems. For example, longer gun tubes tend to bend or flex to a degree sufficient to adversely affect targeting accuracy. This flexion can be the result of many factors, such as differential thermal warming or cooling (thermal bending), vertical or heave acceleration, and firing of the gun. The result of this bending of the gun tube is deflection of the muzzle from its desired position. Therefore, the assumption of conventional stabilization systems that the muzzle position (and, thus, the line of fire) can accurately be determined by monitoring the position of the gun tube at the gun mount does not hold true for longer, flexible gun tubes.

It is known in the prior art to adjust the position of the gun tube to account for thermal bending by a system which utilizes a muzzle reference sensor having a transmitter/receiver located at the breech of the gun to reflect and sense light off a mirror located at the gun muzzle. This muzzle reference sensor operates or samples at approximately 60 Hz; fast enough to account for thermal effects, which have time constants on the order of minutes, but not fast enough to account for higher frequency effects, such as terrain induced disturbances and gun firing reaction. More recently, a continuous muzzle reference sensor has been developed which has sufficient bandwidth to measure these higher frequency flexions. However, no one has heretofore provided a system for controlling these deflections of the muzzle. Rather, weapon stabilization systems continue to operate on the erroneous assumption that the muzzle position is accurately determinable by measuring gun tube position at the gun mount. It would therefore be desirable to have a weapon stabilization system that reduces the error in muzzle position caused by flexion of the gun tube.

Another problem that arises with the use of longer gun tubes is that, whereas the center of gravity of the gun tube has traditionally been designed to coincide with the trunnion axis, the longer tubes, in conjunction with other constraints such as weight and space, have resulted in the center of gravity being offset from the trunnion axis in a direction toward the muzzle. The gun tube is therefore unbalanced at its pivot point. The gun tube will thus experience translational and rotational accelerations due to disturbances caused by the terrain. As used herein, these accelerations are referred to as external accelerations because they are accelerations of the gun tube that are not caused by operation of the actuator.

These external accelerations provide a torque that backdrives the actuator that controls the elevational position of the gun tube. Often, the actuators used are hydraulic actuators and the stabilization system includes pressure feedback from the actuator in the form of negative feedback that dampens the response of the actuator to the command sent from the operator controls. In such systems, the externally applied torque due to the imbalance of the gun tube creates undesirable positive feedback to the actuator that moves or tends to move the actuator in the direction of the backdriving torque. Thus, for example, an external force directed downward at the gun muzzle creates feedback to the actuator that tends the move the muzzle downward. This result is undesirable because the stabilization system should maintain the chosen line of fire irrespective of external forces on the gun tube.

The external accelerations acting on the actuator due to the imbalance of the gun tube can be categorized as either static or dynamic. Static, or one-g external acceleration is that due to the effect of earth's gravity. Dynamic external acceleration is that due to other external accelerations, such as terrain induced disturbances. For example, if the tank hits a bump while moving it may experience two-g's of acceleration, the static one-g plus one-g due to the upward movement of the tank as a result of encountering the bump in the terrain.

It is known to provide a separate stabilization system to account for unbalance due to static acceleration of the gun tube. One such system includes a vessel of pressurized nitrogen gas coupled into the actuator to bias the actuator by an amount equal and opposite to the static force due to the imbalance of the gun. Mechanical arrangements have also been described, as exemplified by U.S. Pat. Nos.: 5,014,594, issued May 14, 1991 to Mühlhausen et al.; 5,101,708, issued Apr. 7, 1992 to Sommer et al.; and 5,196,642, issued Mar. 23, 1993 to Tripp. Mühlhausen et al. and Sommer et al. utilize a torsion bar suspension mechanism to counteract the unbalance. Tripp utilizes a wire cable extending about a contoured cam surface with one end connected to the weapon barrel and the other end connected to a pneumatic cylinder that operates to extend or retract the cable. The compensating force is provided by the pneumatic cylinder, with a magnitude determined by the contour of the cam surface.

These unbalance compensation systems are disadvantageous primarily because they do not counteract for the dynamic torques that a tank or other movable platform is likely to encounter. It would therefore be desirable to have an unbalanced weapon stabilization system utilizing a hydraulic actuator with pressure feedback that accounts for the positive feedback created due to dynamic external accelerations.

SUMMARY OF THE INVENTION

In accordance with one aspect of the present invention, there is provided a muzzle position controller for a weapon stabilization system that includes a pivotable gun tube having a muzzle and an actuator for pivoting the gun tube. The muzzle position controller comprises a muzzle reference sensor for measuring deflections of the gun tube muzzle, and a muzzle deflection feedback circuit operable in response to the muzzle reference sensor to adjust the actuator in accordance with the measured deflections of the muzzle. The measurement of these deflections can be in terms of position, rate, acceleration or otherwise. Preferably, the muzzle reference sensor is operable to measure the position of the muzzle relative to a static position determined by the orientation of a portion of the gun tube that is proximate the actuator.

Preferably, the muzzle reference sensor is operable to produce a vertical position output signal and a horizontal position output signal. The vertical position output signal can then be used by the muzzle deflection feedback circuit to adjust the actuator. Additionally, the horizontal position output signal can be used by the muzzle deflection feedback circuit to adjust the rotational position of a turret on which the gun tube is mounted.

The muzzle deflection feedback circuit preferably is a PD (proportional plus differential) controller, with the differential term being provided by a bandwidth limited differentiator.

The muzzle position controller of the present invention compensates for deflections of the gun tube that degrade the firing accuracy. Rather than relying upon the assumption that the gun tube position, as measured at the gun mount, is an accurate indication muzzle position, the present invention monitors the actual position of the gun muzzle and uses that position to adjust the actuator to maintain the desired line of fire.

In accordance with another aspect of the present invention, a feedforward controller is provided to accommodate the use of an unbalanced gun tube in a stabilization system that uses a hydraulic actuator with pressure feedback. The feedforward controller compensates for the positive error generated by the pressure feedback due to dynamic external accelerations of the gun tube.

The feedforward controller comprises a sensor operable to detect the dynamic external accelerations and a feedforward circuit responsive to the sensor and operable to compensate for pressure feedback resulting from the dynamic external accelerations. Preferably, the sensor is a linear accelerometer. The accelerometer can be located on the gun mount or cradle from which the gun tube extends. The gun mount is pivotable so that the elevation of the gun tube can be changed as desired.

The accelerometer can be located on the pivot axis of the gun tube. Alternatively, a pair of accelerometers can be used which are located on the plane containing the pivot axis and the center of gravity of the gun tube. In this embodiment, the sensors and the feedforward circuit are configured such that the feedforward circuit is operable to determine the components of the dynamic external accelerations that are perpendicular to the plane. These components can then be determined in accordance with the location and orientation of the sensors relative to the axis. Even more generally, a plurality of accelerometers can be used, the dynamic external acceleration being determined in accordance with the accelerometers' relative distances and orientation from the pivot axis.

In accordance with yet another aspect of the present invention, a rotational acceleration feedback controller is provided which utilizes the pair of accelerometers used by the feedforward controller. The feedback controller includes a rotational acceleration feedback circuit responsive to the accelerometers to provide the actuator with a damping signal that is related to the rotational acceleration of the gun tube about the axis.

BRIEF DESCRIPTION OF THE DRAWINGS

The preferred exemplary embodiment of the present invention will hereinafter be described in conjunction with the appended drawings, wherein like designations denote like elements, and.

PRIOR ART WEAPON STABILIZATION SYSTEM

Figure 1:
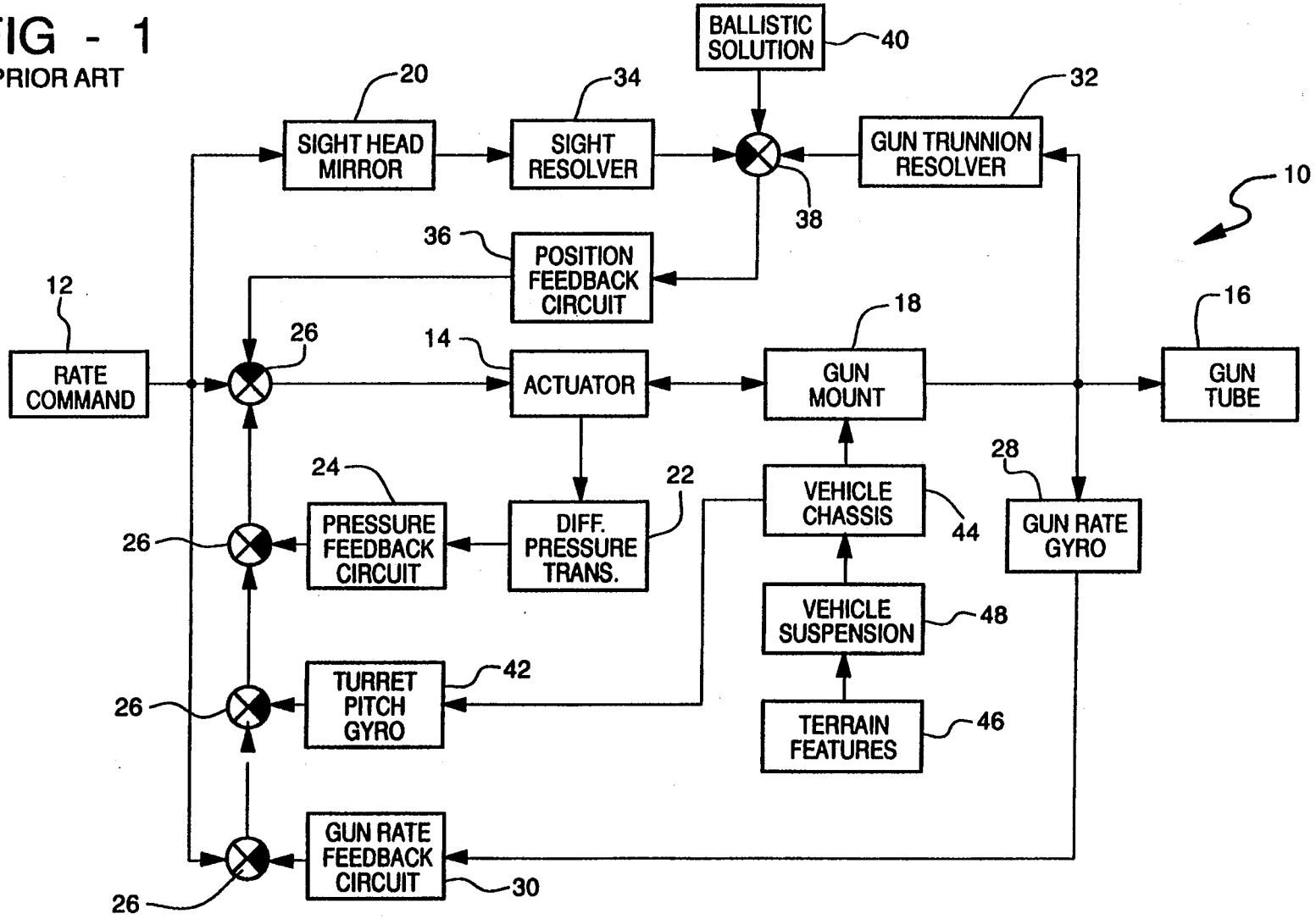
FIG - 1 PRIOR ART
FIG. 1 is a block diagram of a prior art weapon stabilization system.

In FIG. 1 there is shown a block diagram representing a prior art weapon stabilization system for an M1A1 tank. The system is designated generally as 10 and is responsive to a rate command 12 to cause movement via a hydraulic actuator 14 of a gun tube 16 which extends from a gun mount or cradle 18. Gun mount 18 is pivotally mounted on a turret (not shown) that is hydraulically actuated to pivot about its yaw axis. The turret includes its own stabilization system (not shown) that is responsive to rotate the turret in accordance with rate command 12. As is known, rate command 12 also controls the elevational position of a sight head mirror 20.

Sight head mirror 20 is stabilized by its own, independent stabilization system which is not shown.

As FIG. 1 indicates, there are three separate feedback loops and one feedforward input to stabilize the position of the gun tube. The first feedback loop utilizes pressure feedback from actuator 14 in the form of a differential pressure (ΔP) transducer 22 connected to a pressure feedback circuit 24 that generates a pressure feedback signal which is subtracted from rate command 12 at a summing junction 26. The second feedback loop utilizes a gun rate gyro 28 and a gun rate feedback circuit 30. Gun rate gyro 28 is connected to gun mount 18 and detects the actual velocity of gun tube 16. This actual rate is compared to the commanded rate (rate command 12) to generate an error command used to adjust actuator 14. In particular, the output of gun rate gyro 28 is provided to gun rate feedback circuit 30, the output of which is subtracted at summing junction 26. The third feedback loop utilizes a gun trunnion resolver 32, a sight resolver 34, and a position feedback circuit 36. This feedback loop compares the position of gun tube 16 with the position of the sight head mirror 20 at a summing junction 38. A ballistic solution 40 is also injected at summing junction 38 to account for necessary differences between the position of sight head mirror 20 and gun tube 16. As mentioned above, these differences are due to such things as the trajectory of the ammunition and the speed of a moving target. Summing junction 38 is connected to the input to position feedback circuit 36, the output of which is provided to summing junction 26 to thereby adjust actuator 14.

The feedforward input is used to adjust the position of gun tube 16 to account for angular changes of the turret about its pitch axis. This is accomplished using a turret pitch gyro 42 that is connected to the tank turret 44. Thus, terrain features 46 that are coupled to tank turret 44 via the tank suspension 48 and that result in the tank pitching forward and backward are detected by turret pitch gyro 42. The output of turret pitch gyro 42 is provided to summing junction 26 to thereby adjust actuator 14. The signal coming from turret pitch gyro 42 is a feedforward rather than a feedback input because it is not feeding back information relating to actuator position or performance, but is measuring and using a separate environmental parameter (pitch) that is not affected by operation of actuator 14.

DESCRIPTION OF THE PREFERRED EMBODIMENT

Figure 2:
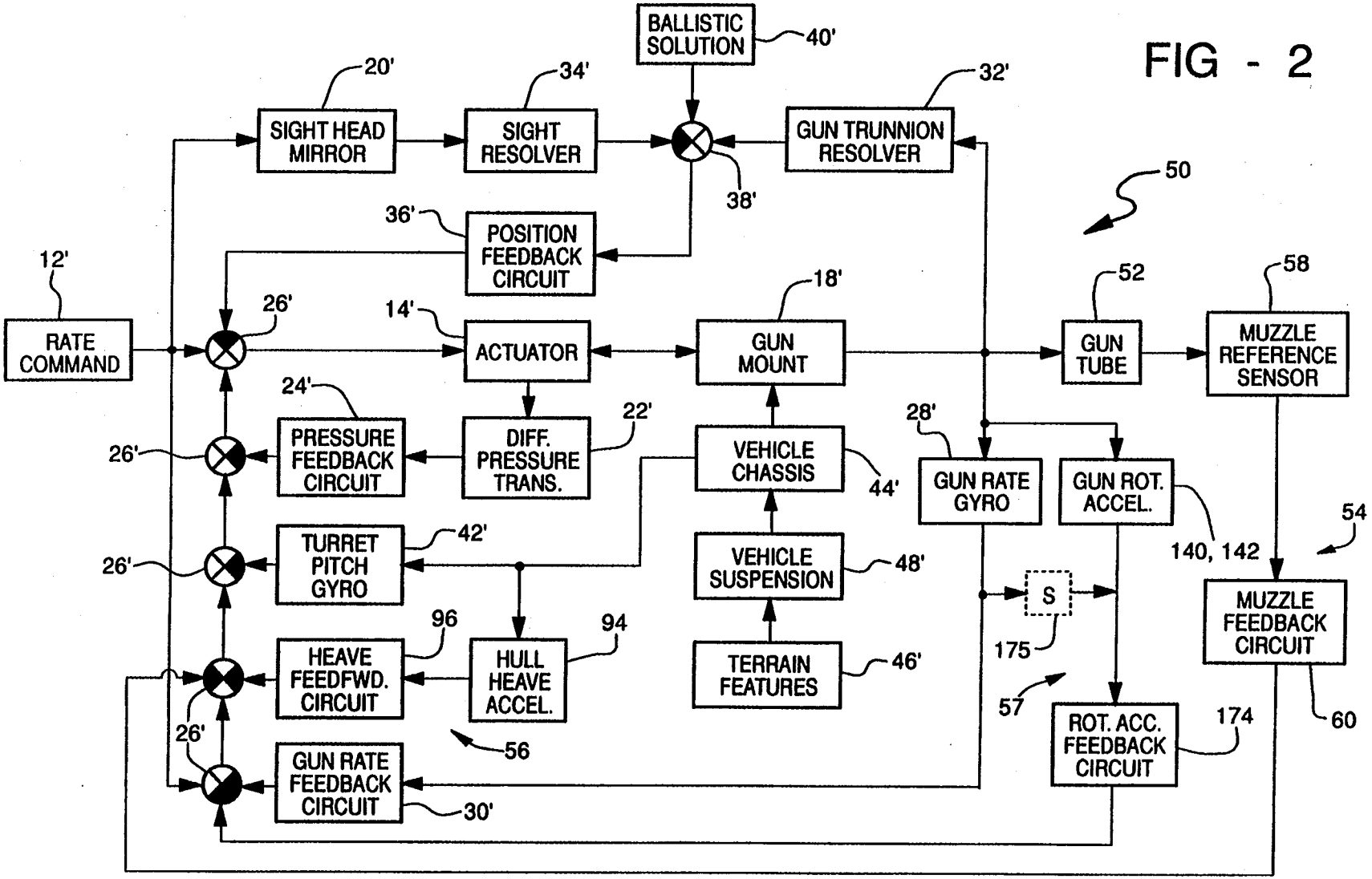
FIG. 2 is a block diagram of a preferred embodiment of the improved weapon stabilization system of the present invention.

FIG. 2 shows a weapon stabilization system 50 of the present invention for an unbalanced, flexible gun tube 52. Primed numerals have been used to designate elements in common with weapon stabilization system 10 of FIG. 1.

Stabilization system 50 includes a muzzle position controller 54, a hull heave feedforward controller 56, and a rotational acceleration feedback controller 57. As discussed in greater detail below, muzzle position controller 54 operates to stabilize the position of the gun muzzle to account for deflections of gun tube 52 that affect its targeting accuracy. This is accomplished by measuring the change in muzzle position relative to a static position determined by the orientation of gun tube 52 at gun mount 18'. The vertical component of the change in position is then used to indicate the elevational error of the muzzle with respect to the desired position, as determined by the position of actuator 14'. This error is used to generate a flexion correction signal that is fed back to summing junction 26' to adjust actuator 14' to correct the muzzle position.

Hull heave feedforward controller 56 operates to compensate for undesirable positive feedback from pressure transducer 22' that is due to dynamic external accelerations which backdrive actuator 14' because of the imbalance of gun tube 52. This is accomplished by using sensors attached to gun mount 18' to determine the dynamic external accelerations of gun tube 52. Since the amount of gun tube imbalance is known, the torque, the resulting differential pressure in actuator 14', and thus the positive error fed back by pressure feedback circuit 24' are all determinable. Accordingly, the heave feedforward signal generated by hull heave feedforward controller 56 in response to these dynamic external accelerations can be set equal to that needed to cancel out the positive feedback.

As is also discussed in greater detail below, rotational acceleration feedback controller 57 operates to provide a damping feedback to the input of actuator 14'. This is done using the same sensors used by feedforward controller 56.

Muzzle Position Controller

Figure 3:
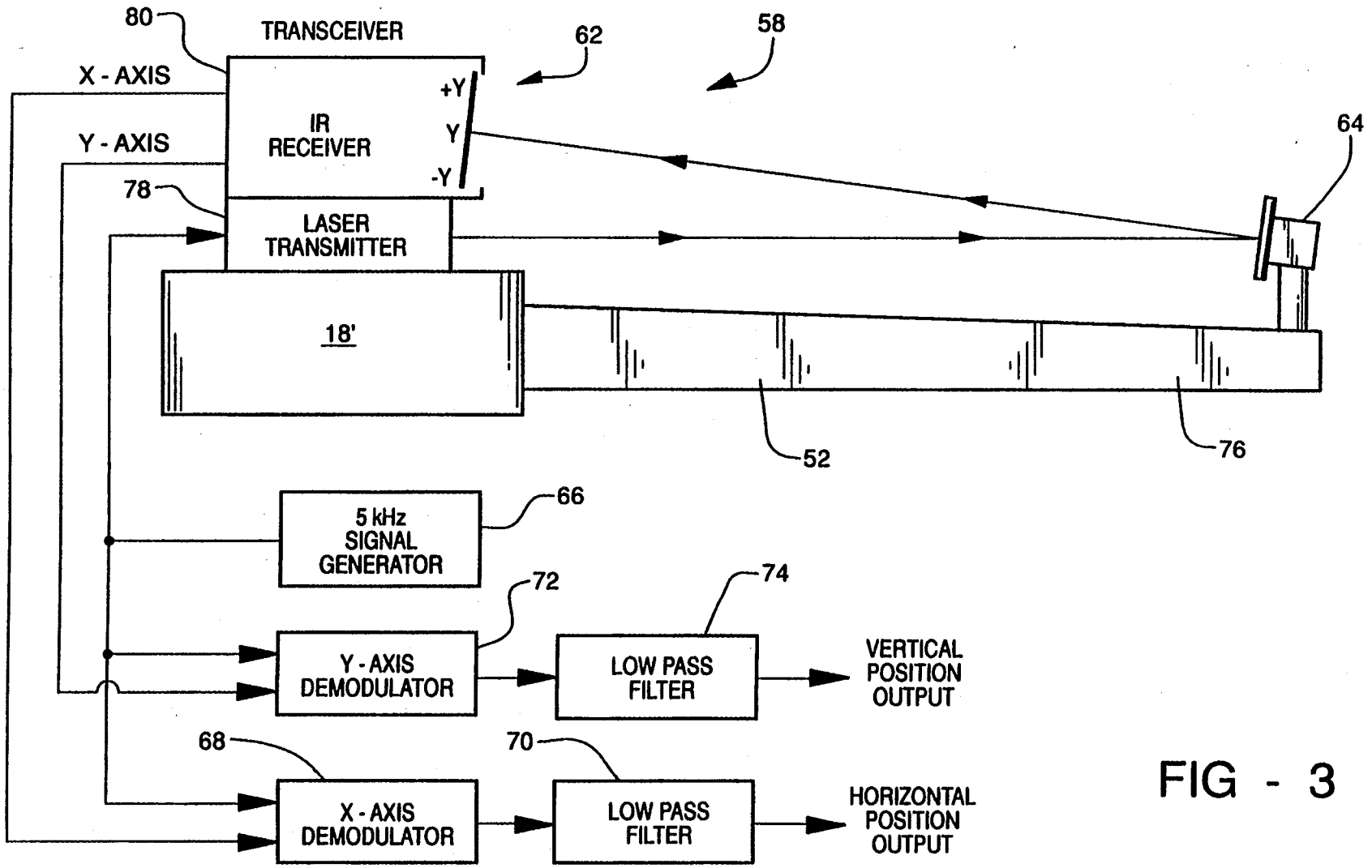
FIG. 3 is a block diagram of the muzzle reference sensor shown in FIG. 2.

Muzzle position controller 54 comprises a muzzle reference sensor 58 and a muzzle deflection feedback circuit 60. Muzzle reference sensor 58 is connected to gun tube 52 and is used to measure the amount of flexion of gun tube 52. In particular and with reference to FIG. 3, muzzle reference sensor 58 comprises an IR transceiver 62, a target mirror 64, a 5 kHz signal generator 66, an X-axis demodulator 68, an X-axis low pass filter 70, a Y-axis demodulator 72, and a Y-axis low pass filter 74. IR transceiver 62 is mounted on gun mount 18', while mirror 64 is mounted at the muzzle 76 of gun tube 52. Transceiver 62 includes an infrared diode laser 78 that outputs a beam of light having a wavelength of 900 to 1000 nanometers. The output of laser 78 is modulated at a frequency of 5 kHz using the output of signal generator 66. Transceiver 62 also includes an IR receiver 80 that receives light having a wavelength of 800 to 1100 nanometers. IR receiver 80 detects the laser beam by distinguishing the 900 to 1000 nanometer light modulated at 5 kHz from ambient background sources. IR receiver 80 detects in two axes and is operable to output a pair of orthogonally-related muzzle deflection signals: an X-axis output voltage and a Y-axis output voltage. Each of these output voltages are proportional to the distance along its respective axis between the impinging laser beam and the origin of the two coordinate axes.

The laser beam is directed to mirror 64 which is oriented to reflect the laser beam back to IR receiver 80. More specifically, mirror 64 is oriented such that, when gun tube 52 is not flexed (i.e., when gun muzzle 76 is at its static position such that the actual line of fire is equal to the line of fire measured by gun trunnion resolver 32'), the laser light will impinge at or near the center of mirror 64 and the laser light reflected from mirror 64 will impinge upon IR receiver 80 at the origin of the coordinate axes. Then, any bending or flexion of gun tube 52 that causes deflection of the gun muzzle from the static position will cause a linear displacement of the impinging laser beam from the origin of IR receiver 80. This displacement is a measure of the angular displacement of mirror 64 and, for the X-axis, can be determined in accordance with the equation:

$$x = x_o + d \sin(2\theta_{mx}), \quad (1)$$

where:

x=is the lateral beam displacement, $x_o$=the static beam location (e.g., the origin of the axes), d=the distance between transceiver 62 and mirror 64, and $\theta_{mx}$=the angular displacement in the X-axis direction of mirror 64 from the static position.

For small angles, the equation can be simplified as:

$$x=x_o+2d\theta_{mx}. \quad (2)$$

The Y-axis calculation is similar and is given by the equation:

$$y=y_o+d\sin(2\theta_{my}), \quad (3)$$

where:

y=is the lateral beam displacement, $y_o$=the initial beam location (e.g., the origin of the axes), d=the distance between transceiver 62 and mirror 64, and $\theta_{my}$=the angular displacement in the Y-axis direction of mirror 64 from the static position.

Again, for small angles, the equation can be simplified as:

$$y=y_o+2d\theta_{my}. \quad (4)$$

X-axis demodulator 68 receives the X-axis output signal from IR receiver 80 and demodulates this signal, thereby producing a continuous signal. This demodulated signal is then filtered by X-axis low pass filter 70, which has a 3 dB cut-off frequency of 500 Hz. The output of low pass filter 70 is a horizontal position output signal. Y-axis demodulator 72 and low pass filter 74 operate in a similar manner to produce a vertical position output signal.

The Y-axis of muzzle reference sensor 58 is oriented to be perpendicular to the pivot axis of gun tube 52 and perpendicular to the line of fire. Thus, Y-axis deflections of gun muzzle 76 that are detected by muzzle reference sensor 58 correspond to elevational changes of muzzle 76 from its static position. These elevational deflections can be compensated for by adjusting the position of actuator 14'; that is, no left to right correction of the tank turret is required to correct for Y-axis components of the deflection of the muzzle. In a like manner, X-axis deflections can be compensated for by adjusting the angular position of the tank turret about its yaw axis, without any adjustment needed of the position of actuator 14'. Therefore, as is discussed below, the vertical position output is used to adjust actuator 14' to correct the elevational position of gun tube 52, while the horizontal position output is used to adjust the gun turret actuator to correct the horizontal position of gun tube 52.

Figure 4:
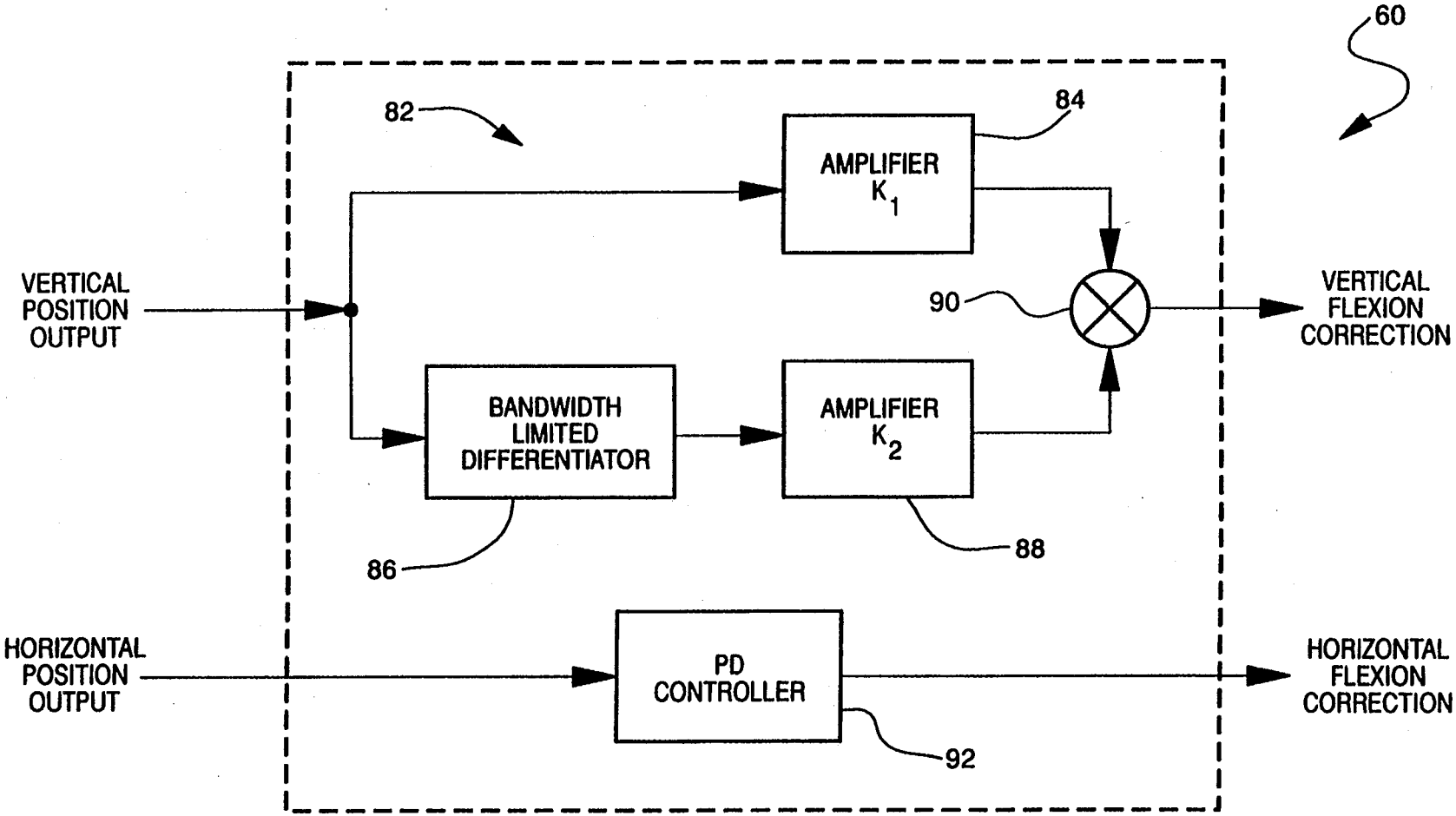
FIG. 4 is a block diagram of the muzzle deflection feedback circuit of FIG. 2.

Referring now to FIG. 4, muzzle deflection feedback circuit 60 is responsive to the vertical position output signal to generate a vertical flexion correction signal that adjusts the position of the gun tube actuator. As FIG. 4 indicates, feedback circuit 60 comprises a PD (proportional plus derivative) controller 82 having a first amplifier 84 that provides the proportional term and a bandwidth limited differentiator 86 that provides the differential term. Feedback circuit 60 also includes a second amplifier 88 that scales the differential term. The proportional and scaled differential terms are added at a summing junction 90 to thereby form the vertical flexion correction signal that is provided to summing junction 26'. Preferably, differentiator 86 is a bandwidth-limited differentiator having a center frequency of 80 Hz so that it therefore differentiates up to 80 Hz and rolls off at a second order rate above that frequency.

As will be understood by those skilled in the art, the scaling of the proportional and differential terms, as well as the cut-off frequencies of differentiator 86, can be chosen in accordance with the particular application of muzzle position controller 54. Additionally, muzzle deflection feedback circuit 60 can be implemented as either an analog circuit, using active and passive components, or a digital circuit, using a microprocessor programmed in a manner known to those skilled in the art.

Muzzle deflection feedback circuit 60 can also include a second PD controller 92 that receives the horizontal position output signal and that generates a horizontal flexion correction signal that is used in the turret stabilization system to adjust the position of the turret. Again, the particular characteristics of PD controller 92 would be selected in accordance with the particular turret or other platform for which muzzle position controller 54 was being used.

Hull Heave Feedforward Controller

Referring again briefly to FIG. 2, hull heave feedforward controller 56 comprises an acceleration sensor assembly 94 and a hull heave feedforward circuit 96 that is responsive to sensor assembly 94 to provide a hull heave feedforward signal to summing junction 26'. As mentioned above, feedforward controller 56 operates to compensate for positive feedback from pressure feedback circuit 24' that results from dynamic external accelerations acting on unbalanced gun tube 52. Also, as defined above, dynamic external accelerations of gun tube 52 are accelerations of gun tube 52 that are not caused by operation of actuator 14' and that are not due to the earth's static one-g gravitational pull. A common type of dynamic external accelerations are terrain-induced disturbances that are coupled to gun tube 52 via the vehicle suspension and chassis.

Figures 5, 5A:
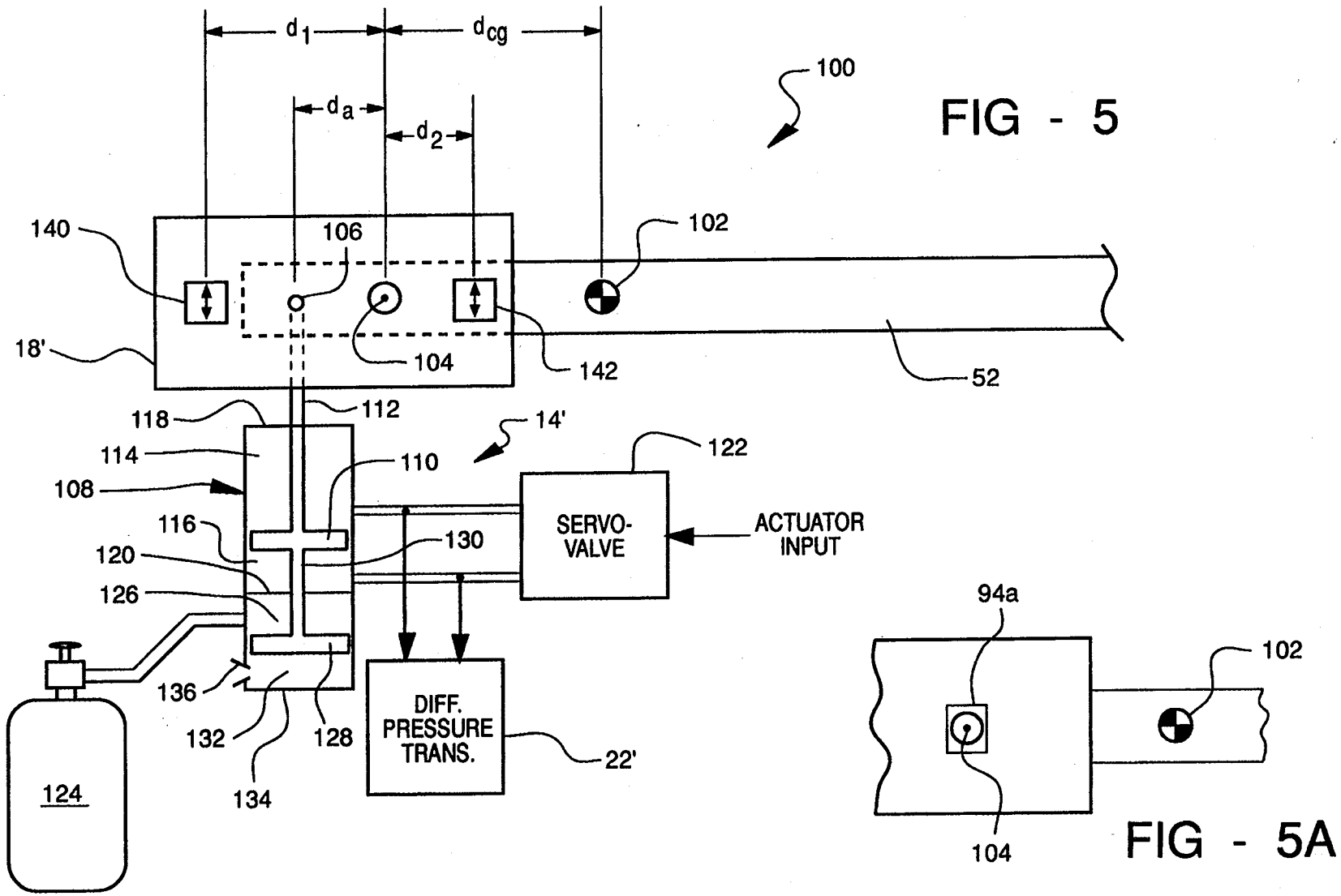
FIG. 5 is a diagrammatic representation of the actuator, gun tube, and gun mount of FIG. 2.
FIG. 5A is a fragmentary schematic diagram of another embodiment of FIG. 5.

Turning now to FIG. 5, the basic construction and operation of actuator 14' will be described. Gun tube 52 extends from gun mount 18', which together comprise a pivotal gun assembly 100 having a center of gravity 102 that is offset from its trunnion or pivot axis 104. Actuator 14' is connected to gun assembly 100 by a coupling mount 106. As shown, actuator 14' includes a cylinder 108 having a piston 110 that is located therein and that is movable along the axis of cylinder 108. Piston 110 has a rigid link 112 to coupling 106 so that movement of piston 110 results in a corresponding movement of gun assembly 100 about trunnion axis 104. Piston 110 defines a pair of chambers 114, 116 within cylinder 108, each of which is located on an opposite side of piston 110. In particular, chamber 114 is defined between a top wall 118 of cylinder 108 and the top surface of piston 110. Chamber 116 is defined between the bottom surface of piston 110 and a fixed, intermediate wall 120 of cylinder 108. Located within each chamber 114, 116 is hydraulic fluid. A servo-valve 122 is connected to cylinder 108 to add or remove hydraulic fluid from each of the chambers 114, 116. As is known, the position of piston 110 within cylinder 108 is determined by the relative quantities of hydraulic fluid in each of the chambers 114, 116. Thus, to move piston 110 downward, and thus, gun tube 52 upward, servo-valve 122 would operate to add hydraulic fluid to chamber 114 while removing fluid from chamber 116. The changes in fluid quantities within chambers 114, 116 create a pressure differential that forces piston 110 in the direction required to equalize the pressures.

To ensure that the response of gun tube 52 is not underdamped, pressure transducer 22' and pressure feedback circuit 24' are used to provide negative feedback. In particular, when rate command 12' is provided to the input of actuator 14', servo-valve 122 operates to change the quantities of hydraulic fluid in chambers 114 and 116 to create a pressure differential between the chambers that causes movement of piston 110 and therefore gun tube 52. This pressure differential is detected by transducer 22' and provided to feedback circuit 24' which subtracts from rate command 12' an amount proportional to the measured differential pressure. This feedback operates to dampen the response of actuator 14' to rate command 12'. Thus, for example, if a rate command 12' is given to raise gun tube 52, servo-valve 122 would operate to add hydraulic fluid to chamber 114 and to remove hydraulic fluid from chamber 116. This would increase the pressure in chamber 114 and decrease the pressure in chamber 116. Pressure feedback circuit 24' would therefore operate to sum a signal into summing junction 26' that tends to reduce this pressure differential; that is, the pressure feedback signal provided by feedback circuit 24' would reduce the flow into chamber 114 and the flow out of chamber 116 to thereby reduce the pressure differential between these chambers.

This pressure feedback loop creates a problem for unbalanced gun tubes, however, because, as is evident by inspection of FIG. 5, gun assembly 100 will act to pull piston 110 upward due to center of gravity 102 being offset from trunnion axis 104 toward the muzzle of gun tube 52. The force on actuator 14' resulting from this imbalance increases the pressure in chamber 114 and reduces the pressure in chamber 116. Thus, a pressure differential is created that, as discussed above, causes feedback circuit 24' to adjust actuator 14' in a manner tending to reduce the pressure differential. Consequently, even if the rate command 12' is zero (i.e., no movement of gun tube 52 is being commanded), the pressure differential will cause feedback circuit 24' to provide an input to actuator 14' that removes fluid from chamber 114 and adds fluid to chamber 116, thereby moving gun tube 52 downward. It will therefore be appreciated that the downward force on gun tube 52 due to gravity creates a pressure differential that results in actuator 14' being operated to move gun tube 52 downward. The converse is equally true for an externally applied force directed upwards. The upward force increases the pressure in chamber 116 above that in chamber 114 and pressure feedback circuit 24' is operable to move gun tube 52 upward to equalize the pressures in the chambers.

This use of pressure feedback is undesirable because it is not damping the response of actuator 14' to a rate command 12', but rather is responding to an externally applied force to move the gun tube in the direction of the applied force. Thus, the pressure feedback produces a positive feedback in response to external accelerations of gun tube 52. To cancel this positive feedback, the force on actuator 14' resulting from the static and dynamic external accelerations of gun tube 52 must be determined. That force is dependent on the torque created at trunnion axis 104 due to the offset of center of gravity 102 toward the gun muzzle. That offset defines a torque arm having a distance $d_{cg}$. Since accelerations of gun assembly 100 act as if they are concentrated at center of gravity 102, external accelerations of gun tube 52 will create a torque $\tau$ at trunnion axis 102. This torque can be calculated according to the equation:

$$\tau = m_g a_e d_{cg}, \tag{5}$$

where:

$m_g$ = the mass of gun assembly 100, $a_e$ = the measured external acceleration, and $d_{cg}$ = the distance of center of gravity 102 from trunnion axis 104.

This torque creates a force $F_a$ on actuator 14' that can be determined using the equation:

$$F_a = \frac{\tau}{d_a} = \frac{m_g a_e d_{cg}}{d_a}, \tag{6}$$

where $d_a$ is the distance between the coupling 106 and trunnion axis 104.

This force is made up of two components: a static force $F_g$ due to the static, one-g acceleration of earth's gravity, and a dynamic force $F_{de}$ due to dynamic external accelerations. Thus, $$a_e = g + a_{de} \tag{7}$$

where:

g = acceleration due to earth's gravity, and $a_{de}$ = the dynamic external acceleration.

Substitution of equation (7) into equation (6) yields:

$$F_a = \frac{m_g(g + a_{de})d_{cg}}{d_a} = \frac{m_g g d_{cg}}{d_a} + \frac{m_g a_{de} d_{cg}}{d_a}. \tag{8}$$

Since $F_g$ is the component of the force $F_a$ on actuator 14' that is due to earth's static, one-g acceleration g, and since $F_{de}$ is the component of the force $F_a$ that is due to the dynamic external acceleration $a_{de}$, it follows that:

$$F_g = \frac{m_g g d_{cg}}{d_a} \tag{9}$$

and $$F_{de} = \frac{m_g a_{de} d_{cg}}{d_a}. \tag{10}$$

Since all of the variables of equation (9) are predeterminable and do not vary for a particular gun tube and actuator arrangement, the force $F_g$, which acts to pull piston 110 upward, can be predetermined. Furthermore, for any particular actuator 14', the pressure resulting from force $F_g$ can be predetermined and therefore, the compensation necessary to counteract force $F_g$ can be predetermined. As shown in FIG. 5, this compensation can be in the form of a vessel 124 of nitrogen gas coupled to actuator 14'. The gas pressurizes a chamber 126 defined between intermediate wall 120 and the top surface of a second piston 128 that is rigidly connected to piston 110 by a second link 130. A lower chamber 132 defined between the lower surface of piston 128 and a bottom wall 134 of cylinder 108 allows downward travel of piston 128 and is open to the atmosphere by a vent 136.

The pressure within chamber 126 is selected to generate a downward force on piston 128 that is equal and opposite to the static force $F_g$. In this manner actuator 14' counteracts $F_g$ and prevents $F_g$ from causing a pressure differential between chambers 114 and 116 that generates a positive feedback. However, dynamic external accelerations that create the dynamic force $F_{de}$ on actuator 14' must still be accounted for since they also create undesirable positive feedback.

In accordance with the invention, this is done by measuring the dynamic external accelerations $a_{de}$, which is the only variable in equation (10) that cannot be predetermined. Using this measured acceleration, the force $F_{de}$ can be determined and, using the known characteristics of a particular actuator 14' and pressure transducer 22', the signal generated by transducer 22' and, thus, the positive feedback provided by feedback circuit 24' can be determined and eliminated. In practice, the force $F_{de}$ need not actually be calculated, but rather hull heave feedforward circuit 96 can be constructed to respond to the measured dynamic external acceleration $a_{de}$ to generate a signal that cancels the positive feedback supplied to summing junction 26' by feedback circuit 24'.

The measurement of the dynamic external acceleration $a_{de}$ by sensor assembly 94 can be accomplished in various ways without departing from the scope of the present invention. For example, as shown in FIG. 5A, sensor assembly 94 could comprise a single linear accelerometer **94*a* located on trunnion axis 104 and oriented such that its axis is perpendicular to the plane containing trunnion axis 104 and center of gravity 102. In this arrangement, accelerometer 94*a* would provide a direct measurement of the dynamic external acceleration acting on gun assembly 100**.

Alternatively, and as shown in FIG. 5, sensor assembly 94 can comprise a pair of linear accelerometers 140, 142 located on gun mount 18'. Accelerometer 140 is located near the breech of gun assembly 100 while accelerometer 142 is located on the other side of trunnion axis 104 near the point at which gun tube 52 exits gun mount 18'. Accelerometers 140 and 142 are both located on an imaginary plane that contains trunnion axis 104 and center of gravity 102. Furthermore, accelerometers 140 and 142 are oriented such that their axes are perpendicular to that plane. In this way, accelerometers 140 and 142 will only measure the component of the dynamic external accelerations that is perpendicular to and that acts on the torque arm existing between center of gravity 102 and trunnion axis 104.

Since accelerometers 140 and 142 are not located on trunnion axis 104, the accelerations they measure can have two components: a rotational acceleration and a translational acceleration. The rotational component will include acceleration due to operation of actuator 14' for which the pressure feedback from feedback circuit 24' is desirable. The translational component is the hull heave acceleration or, in other words, the dynamic external acceleration which causes the positive feedback that is to be canceled. Thus, the accelerations measured by accelerometers 140 and 142 must be resolved into their component parts.

The equations for the measured accelerations using accelerometers 140 and 142 are, respectively:

$$a_1 = k(a_{de} - d_1\alpha), \tag{11}$$

and $$a_2 = k(a_{de} + d_2\alpha), \tag{12}$$

where:

$a_1$ = the acceleration measured by accelerometer 140,
$a_2$ = the acceleration measured by accelerometer 142,
k = the gain factor for accelerometers 140 and 142,
$d_1$ = the distance between accelerometer 140 and trunnion axis 104,
$d_2$ = the distance between accelerometer 142 and trunnion axis 104, and
$\alpha$ = the rotational acceleration of gun tube 52.

The gain factor k for accelerometers 140 and 142 is an inherent characteristic of the accelerometers that determines the number of volts per unit acceleration that the accelerometers provide. The distances $d_1$ and $d_2$ are knowns. Therefore, the two unknowns of these equations, $a_{de}$ and $\alpha$ can be determined in accordance with the usual methods for solving two independent equations having two unknowns. In particular, subtracting equation (12) from equation (11) yields:

$$a_1 - a_2 = ka_{de} - kd_1\alpha - ka_{de} - kd_2\alpha. \tag{13}$$

Simplifying, this equation becomes:

$$a_1 - a_2 = -kd_1\alpha - kd_2\alpha = -k\alpha(d_1 + d_2). \tag{14}$$

Solving for $\alpha$ yields the equation:

$$\alpha = \frac{a_2 - a_1}{k(d_1 + d_2)}. \tag{15}$$

The dynamic external acceleration $a_{de}$ can be determined by first multiplying equation (11) by $d_2$ and equation (12) by $d_1$ and then moving the $a_{de}$ terms to the left sides of the two resulting equations, as follows:

$$d_2ka_{de} = d_2a_1 - d_2kd_1\alpha, \tag{16}$$

$$d_1ka_{de} = d_1a_1 + d_1kd_2\alpha. \tag{17}$$

Then, these equations are added to obtain:

$$d_2ka_{de} + d_1ka_{de} = d_2a_1 + d_1a_2 - d_2kd_1\alpha + d_1kd_2\alpha. \tag{18}$$

Simplifying equation (18) yields:

$$ka_{de}(d_1 + d_2) = d_2a_1 + d_1a_2. \tag{19}$$

Equation (19) can then be solved for $a_{de}$ to obtain:

$$a_{de} = a_1\left(\frac{d_2}{k(d_1 + d_2)}\right) + a_2\left(\frac{d_1}{k(d_1 + d_2)}\right). \tag{20}$$

Thus, the dynamic external acceleration $a_{de}$ acting on gun tube 52 can be determined and, using equation (10), the force $F_{de}$ on actuator 14' can be determined.

Figure 6:
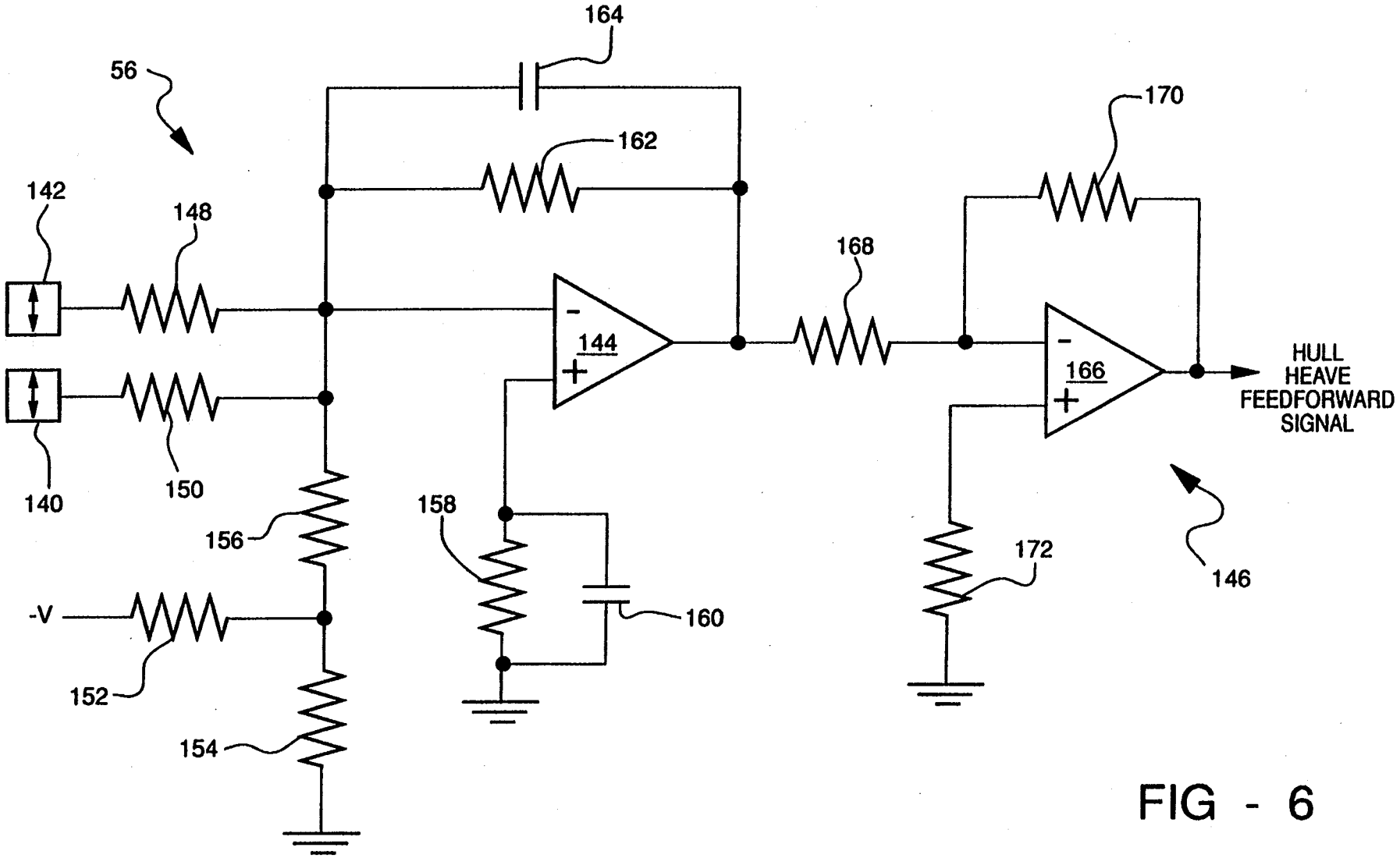
FIG. 6 is a schematic diagram of the hull heave feedforward controller of FIG. 2.

Referring now to FIG. 6, hull heave feedforward controller 96 is shown. Feedforward controller 96 receives as its inputs the accelerations measured by accelerometers 140 and 142. It combines these inputs using an operational amplifier 144 that outputs a signal proportional to their sum. The output of op-amp 144 is scaled by an amplifier 146 as needed to generate the hull heave feedforward signal that is provided to summing junction 26' to cancel the positive feedback produced by feedback controller 24'.

In particular, the output of accelerometer 142 is provided to the inverting input of op-amp 144 via an input resistor 148. The output of accelerometer 140 is provided to the inverting input via a second input resistor 150. The inverting input is negatively biased via a resistor divider comprising resistors 152 and 154 and a third input resistor 156. The non-inverting input of op-amp 144 is set to zero volts through a resistor 158 and a filter capacitor 160. A feedback resistor 162 is used to provide the desired amount of amplification in accordance with its value relative to the three input resistors 148, 150, and 156. Capacitor 164 provides a high frequency roll-off.

As equation (20) above indicates, the difference between the accelerations measured by accelerometers 140 and 142 is related to the relative distances of those accelerometers from trunnion axis 104. This difference is accounted for by selecting the relative values of resistors 148 and 150 equal to the ratio of distances $d_2$ and $d_1$. That is, the values of resistors 148 and 150 are selected in accordance with the equation:

$$\frac{R_{148}}{R_{150}} = \frac{d_2}{d_1}. \tag{21}$$

Amplifier 146 includes an op-amp 166, an input resistor 168, a feedback resistor 170, and a resistor 172 that ties the non-inverting input of op-amp 166 to ground. The relative values of resistors 168 and 170 are selected such that the feedforward signal generated by op-amp 166 will be of equal magnitude (but opposite polarity) to the pressure feedback signal generated by feedback circuit 24' when gun tube 52 is subjected to a purely dynamic external acceleration. With the resistor values thus set, feedforward circuit 96 will cancel the positive error generated by feedback circuit 24' due to dynamic external accelerations.

Preferably, accelerometers 140 and 142 are connected directly to either gun tube 52 or gun mount 18'; however, in the broader aspects of the invention they can be located anywhere suitable for detecting the dynamic external accelerations experienced by gun tube 52. Accelerometers 140 and 142 can both be model 4855F5-A accelerometers manufactured by Systron Donner of Concord, Calif. Suitable values for the resistors and capacitors of feedforward circuit 96 are given in the Appendix. Op-amps 144 and 166 can each be one fourth of a OP400 quad op-amp, manufactured by Precision Monolithic Incorporated.

Rotational Acceleration Feedback Controller

Figure 7:
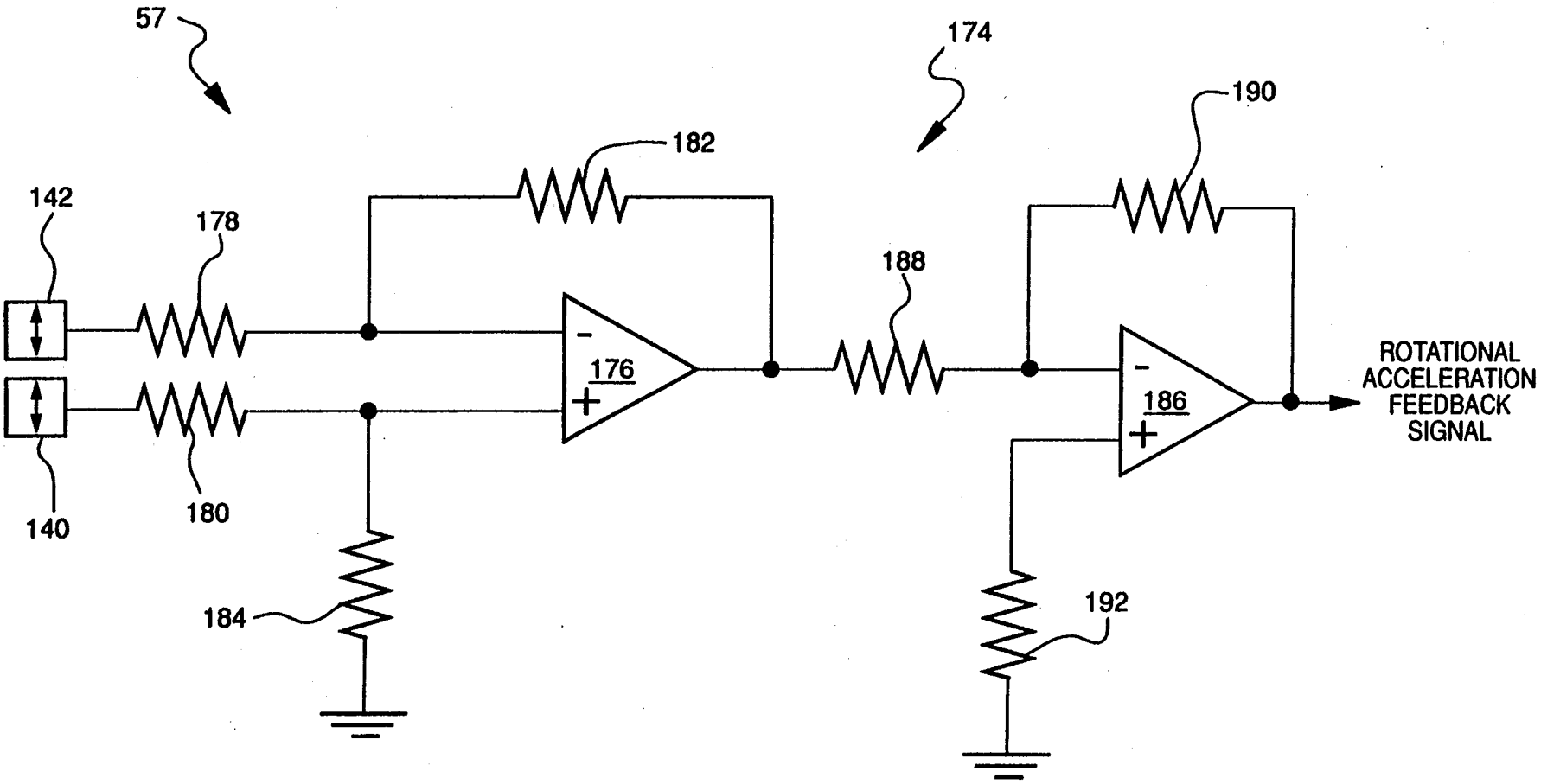
FIG. 7 is a schematic diagram of the rotational acceleration feedback controller of FIG. 2.

Referring now to FIG. 7, rotational acceleration feedback controller 57 is shown. Feedback controller 57 utilizes accelerometers 140 and 142 and a rotational acceleration feedback circuit 174. However, as will be appreciated by those skilled in the art, the output of gun rate gyro 28' could be differentiated, as indicated at block 175 of FIG. 2, and used in lieu of accelerometers 140 and 142.

Feedback circuit 174 includes a first stage comprising an op-amp 176 with a first input resistor 178 that couples accelerometer 142 to the inverting input of op-amp 176 and a second input resistor 180 that couples accelerometer 140 to the non-inverting input. The summing of the accelerometers into opposite inputs of op-amp 176 performs the subtraction of the accelerometer outputs, as required by equation (15). Resistors 182 and 184 provide the desired level of amplification. No relative proportioning of the outputs of accelerometers 140 and 142 is needed so that resistors 178 and 180 can be equal and resistors 182 and 184 can be equal.

Rotational acceleration feedback circuit 174 additionally includes a second op-amp 186 that provides the desired level of amplification of the output of op-amp 176. It utilizes an input resistor 188 connected between the output of op-amp 176 and the inverting input of op-amp 186, as well as a feedback resistor 190 connected between the output and inverting input of op-amp 186. A resistor 192 connects the non-inverting input of op-amp 186 to ground. As shown in FIG. 2, the output of feedback circuit 174 (i.e., the output of op-amp 186) is provided to summing junction 26'. If desired, rate command 12' could be differentiated and compared to this output to generate an error term that adjusts actuator 14'. However, this comparison is not necessary since the feedback provided by rotational acceleration feedback circuit 174 operates in any event to dampen the response of gun tube 52 to rate command 12'. Component values for the resistors and capacitors of feedback circuit 174 are also given in the Appendix. Op-amps 176 and 186 can be the same type as op-amps 144 and 166.

It will thus be apparent that there has been provided in accordance with the present invention an improved weapon stabilization system which achieves the aims and advantages specified herein. It will of course be understood that the foregoing description is of preferred exemplary embodiments of the invention and that the invention is not limited to the specific embodiments shown. Various changes and modifications will become apparent to those skilled in the art and all such variations and modifications are intended to come within the spirit and scope of the appended claims.

APPENDIX

| Reference Numerals | Value |
|---|---|
| Resistors | |
| 148 | 51.1KΩ |
| 150 | 200KΩ |
| 152 | 25.5KΩ |
| 154 | 24.3KΩ |
| 156 | 200KΩ |
| 158 | 25.7KΩ |
| 162 | 82.5KΩ |
| 168 | 133KΩ |
| 170 | 100KΩ |
| 172 | 57KΩ |
| 178 | 49.9KΩ |
| 180 | 49.9KΩ |
| 182 | 34.8KΩ |
| 184 | 34.8KΩ |
| 188 | 80.6KΩ |
| 190 | 49.9KΩ |
| 192 | 30.8KΩ |
| Capacitors | |
| 160 | 0.1 μF |
| 164 | 0.1 μF |

I claim:

1. In a stabilization system for use with a hydraulic actuator that moves a member which is subjected to dynamic external accelerations that backdrive the actuator, the stabilization system being of the type utilizing an actuator command to control the hydraulic actuator and pressure feedback from the hydraulic actuator to dampen the response of the hydraulic actuator to the actuator command, the improvement comprising:

a sensor operable to detect the dynamic external accelerations when said sensor is coupled to the member; and a feedforward circuit responsive to said sensor and operable to compensate for pressure feedback resulting from the dynamic external accelerations.

2. A stabilization system as defined in claim 1, wherein said sensor comprises a linear accelerometer.

3. A stabilization system as defined in claim 1, wherein said sensor is operable to produce a sensor output signal and said feedforward circuit is operable to generate a feedforward signal that is proportional to said sensor output signal.

4. In a weapon system of the type having:

a platform;

a gun tube disposed on said platform and pivotable about an axis;

a hydraulic actuator having an input and being coupled to said gun tube to control the position of said gun tube about said axis in accordance with an input signal on said input; and a pressure feedback circuit operable to provide feedback to said input in response to pressure created in said actuator resulting from operation of said actuator by the input signal;

the improvement comprising:

said gun tube having a center of gravity that is offset from said axis, whereby dynamic external accelerations of said gun tube produce a backdriving force on said actuator which results in said pressure feedback circuit providing positive feedback to said input;

a sensor coupled to said gun tube to detect the dynamic external accelerations of said gun tube; and a feedforward circuit coupled to said input and operable in response to said sensor to compensate for the positive feedback resulting from the dynamic external accelerations.

5. A weapon system as defined in claim 4, wherein said sensor is a linear accelerometer.

6. A weapon system as defined in claim 4, further comprising a gun cradle mounted to pivot about said axis, wherein said gun tube extends from said gun cradle and said sensor is located on said gun cradle.

7. A weapon system as defined in claim 6, wherein said sensor is oriented to measure rotational accelerations of said gun tube about said axis.

8. A weapon system as defined in claim 4, wherein said sensor is located substantially on said axis.

9. A weapon system as defined in claim 4, wherein said sensor is one of a plurality of sensors coupled to said feedforward circuit, said sensors and said feedforward circuit being configured such that said feedforward circuit is operable to determine the components of the dynamic external accelerations that are perpendicular to a plane containing said axis and said center of gravity, the components being determined in accordance with the location and orientation of said sensors relative to said axis.

10. A weapon system as defined in claim 9, wherein said sensors are oriented to measure rotational accelerations of said gun tube about said axis.

11. A weapon system as defined in claim 9, wherein said sensors are located on said plane and wherein said feedforward circuit is operable to determine the components in accordance with the distances of said sensors from said axis.

12. A weapon system as defined in claim 4, further comprising:

a second sensor coupled to said gun tube to detect the dynamic external accelerations of said gun tube; and a rotational acceleration feedback circuit responsive to said sensors to provide said actuator with a damping signal that is related to the rotational acceleration of said gun tube about said axis.

13. A weapon system as defined in claim 4, wherein said pressure feedback circuit is operable to provide said input with a pressure feedback signal having a positive feedback component that results from the dynamic external accelerations, and wherein said feedforward circuit is operable to provide said input with a feedforward signal having substantially equal magnitude, but opposite polarity to the positive feedback component of the pressure feedback signal.

14. A weapon system as defined in claim 4, wherein said platform is rotatable about a second axis that is orthogonal to said first-mentioned axis, said platform having a center of gravity that is offset from said second axis;

wherein the weapon system further comprises:

a second hydraulic actuator having a second input and being coupled to said platform to rotate said platform about said second axis in accordance with a second input signal on said second input;

a second pressure feedback circuit operable to provide negative feedback to said second input in response to pressure created in said second hydraulic actuator resulting from operation of said second actuator by the second input signal, whereby dynamic external accelerations of said platform produce a backdriving force on said second actuator which results in said second pressure feedback circuit providing positive feedback to said second input;

a second sensor coupled to said platform to detect dynamic external accelerations of said platform; and a second feedforward circuit coupled to said second input and operable in response to said second sensor to compensate for the positive feedback from said second pressure feedback circuit.

15. A weapon system as defined in claim 14, wherein said second sensor is located on a plane containing said second axis and said center of gravity of said platform and wherein said sensor is oriented to measure the components of the dynamic external accelerations that are perpendicular to said plane.

* * * * *